US011688598B2

(12) United States Patent
Jones et al.

(10) Patent No.: US 11,688,598 B2
(45) Date of Patent: Jun. 27, 2023

(54) METHOD OF PRODUCING IONS USING SPRAY DROPLETS ONTO A SAMPLE

(71) Applicant: Micromass UK Limited, Wilmslow (GB)

(72) Inventors: Emrys Jones, Manchester (GB); Steven Derek Pringle, Darwen (GB); Jeffery Mark Brown, Hyde (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 16/604,713

(22) PCT Filed: Apr. 11, 2018

(86) PCT No.: PCT/GB2018/050959

§ 371 (c)(1),
(2) Date: Oct. 11, 2019

(87) PCT Pub. No.: WO2018/189533

PCT Pub. Date: Oct. 18, 2018

(65) Prior Publication Data

US 2021/0118663 A1 Apr. 22, 2021

(30) Foreign Application Priority Data

Apr. 11, 2017 (GB) ..... 1705864

(51) Int. Cl.
*H01J 49/16* (2006.01)
*H01J 49/00* (2006.01)

(52) U.S. Cl.
CPC ..... *H01J 49/165* (2013.01); *H01J 49/0068* (2013.01)

(58) Field of Classification Search
CPC .... H01J 49/0068; H01J 49/0468; H01J 49/10; H01J 49/16; H01J 49/165
See application file for complete search history.

(56) References Cited

U.S. PATENT DOCUMENTS

| | | | | |
|---|---|---|---|---|
| 4,766,313 | A | 8/1988 | Homma et al. | |
| 5,118,937 | A | 6/1992 | Hillenkamp et al. | |
| 7,196,525 | B2 | 3/2007 | Sparkman et al. | |
| 7,335,897 | B2 * | 2/2008 | Takats ..... | H01J 49/142 250/288 |
| 2004/0217283 | A1 | 11/2004 | Bai et al. | |

(Continued)

FOREIGN PATENT DOCUMENTS

| | | | |
|---|---|---|---|
| EP | 0964427 | A2 | 12/1999 |
| GB | 2491486 | A | 12/2012 |

(Continued)

OTHER PUBLICATIONS

Cristoni et al., Development and Applications of Surface-Activated Chemical Ionization, Mass Spectrometry Reviews 26, 645-656 (2007) (Year: 2007).*

(Continued)

*Primary Examiner* — David E Smith
(74) *Attorney, Agent, or Firm* — Goodwin Procter LLP

(57) ABSTRACT

A method of producing ions from a sample is disclosed. The method comprises directing a spray of droplets onto a sample, and causing droplets comprising analyte from the sample to impact upon a surface so as to generate analyte ions.

4 Claims, 8 Drawing Sheets

(56) References Cited

U.S. PATENT DOCUMENTS

| | | | | |
|---|---|---|---|---|
| 2007/0228271 | A1 | 10/2007 | Truche et al. | |
| 2008/0156985 | A1 | 7/2008 | Venter et al. | |
| 2009/0121127 | A1 | 5/2009 | Orlando et al. | |
| 2010/0059674 | A1 | 3/2010 | Chen et al. | |
| 2010/0072359 | A1 | 3/2010 | Briglin et al. | |
| 2010/0078550 | A1 | 4/2010 | Wiseman et al. | |
| 2011/0049352 | A1 | 3/2011 | Ding et al. | |
| 2011/0220784 | A1* | 9/2011 | Roach | H01J 49/0463 250/282 |
| 2012/0080592 | A1 | 4/2012 | Wiseman et al. | |
| 2016/0126080 | A1 | 5/2016 | Kertesz et al. | |
| 2017/0135613 | A1 | 5/2017 | Cooks et al. | |

FOREIGN PATENT DOCUMENTS

| | | | | |
|---|---|---|---|---|
| GB | 2507297 | A | 4/2014 | |
| JP | 2007165116 | A | 6/2007 | |
| WO | 2005094389 | A2 | 10/2005 | |
| WO | 2007/140349 | A2 | 12/2007 | |
| WO | 2008097831 | A1 | 8/2008 | |
| WO | 2009070555 | A1 | 6/2009 | |
| WO | 2011022364 | A1 | 2/2011 | |
| WO | 2012167183 | A1 | 12/2012 | |
| WO | 2016142674 | A1 | 9/2016 | |
| WO | 2016142683 | A1 | 9/2016 | |
| WO | 2016142685 | A1 | 9/2016 | |
| WO | WO-2016142685 | A1 * | 9/2016 | A61B 1/2736 |

OTHER PUBLICATIONS

Harris et al., Ambient Sampling/Ionization Mass Spectrometry: Applications and Current Trends, Anal. Chem. 83, 4508-4538 (2011) (Year: 2011).*

Harris et al, "Ambient Sampling/Ionization Mass Spectrometry: Applications and Current Trends", Anal. Chem. 2011 83,4508-4538 (Year: 2011).*

Harris, et al., "Ambient Sampling/Ionization Mass Spectrometry: Applications and Current Trends", Analytical Chemistry 2011, 83, 4508-4538) (Year: 2011).*

Examination Report under Section 18(3) for Application No. GB1804803.3, dated Dec. 18, 2020, 4 pages.

Search Report for United Kingdom Application No. GB1804803.3 dated Oct. 7, 2019 2 pages.

Search Report for GB Patent Application No. GB1705864.5, dated Sep. 27, 2017, 3 pages.

International Search Report and Written Opinion for International Patent Application No. PCT/GB2018/050959, dated Jul. 9, 2018, 12 pages.

Haddad, R., et al., "Desorption Sonic Spray Ionization for (High) Voltage-Free Ambient Mass Spectrometry", Rapid Commun. Mass Spectrom., 20:2901-2905 (2006).

Hirabayashi, A., et al., "Sonic Spray Mass Spectrometry", Anal. Chem., 67:2878-2882 (1995).

Pagnotti, V. S., et al., "Solvent Assisted Inlet Ionization: An Ultrasensitive New Liquid Introduction Ionization Method for Mass Spectrometry", Anal. Chem., 83:3981-3985 (2011).

Compton, L. R., et al., "Remote Laser Ablation Alectrospray Ionization Mass Spectrometry for Non-Proximate Analysis of Biological Tissues", Rapid Commun. Mass Spectrom., 29:67-73 (2015).

Luo, Z., et al., "Air Flow-Assisted Ionization Imaging Mass Spectrometry Method for Easy Whole-Body Molecular Imaging under Ambient Conditions", Anal. Chem., 85:2977-2982 (2013).

He, J., et al., "Air Flow Assisted Ionization for Remote Sampling of Ambient Mass Spectrometry and its Application", Rapid Commun. Mass Spectrom., 25:843-850 (2011).

Trimpin, S., ""Magic" Ionization Mass Spectrometry", J. Am. Soc. Mass Spectrom., 27:4-21 (2016).

Combined Search and Examination Report for United Kingdom Application No. GB1804803.3, dated Sep. 26, 2018, 9 pages.

International Search Report and Written Opinion for International Application No. PCT/GB2018/050960, dated Sep. 5, 2018, 19 pages.

Search Report for United Kingdom Application No. GB1708835.2, dated Dec. 1, 2017, 3 pages.

Takats, Z., et al., "In Situ Desorption Electrospray Ionization (DESI) Analysis of Tissue Sections",Cold Spring Habor Protocols, 3 (4):1-4, Apr. 2008.

Wiseman, J. M., et al.,"Mass Spectrometric Profiling of Intact Biological Tissue by Using Desorption Electrospray Ionisation", Angewandte Chemie International Edition, 44(43):7094-7097 (2005).

International Search Report and Written Opinion for International Patent Application No. PCT/GB2018/051508, dated Sep. 17, 2018, 15 pages.

Takats et al., "Ambient Mass Spectrometry Using Desorption Electrospray Ionization (DESI): Instrumentation, Mechanisms and Applications in Forensics, Chemistry, and Biology", Journal of Mass Spectrometry, Wiley, Chichester, GB, 40(10):1261-1275, Oct. 1, 2005.

Asano, K. G., et al., "Self-aspirating Atmospheric Pressure Chemical Ionization Source for Direct Sampling of Analytes on Surfaces and in Liquid Solutions", Rapid Communications in Mass Spectrometry, 19:2305-2312 (2005).

Forbes, T. P., et al., "Desorption Electro-Flow Focusing Ionization of Explosives and Narcotics for Ambient Pressure Mass Spectrometry", Analyst, 138:5665-5673 (2013).

Search Report for United Kingdom Application No. GB1804803.3, dated Oct. 1, 2019, 2 pages.

Examination Report under Section 18(3) for Application No. GB1708835.2, dated May 6, 2021, 7 pages.

CNOA for Application No. 201880019342.4 dated May 8, 2021, 7 pages.

* cited by examiner

METHOD OF PRODUCING IONS USING SPRAY DROPLETS ONTO A SAMPLE

CROSS-REFERENCE TO RELATED APPLICATIONS

This application is a national phase filing claiming the benefit of and priority to International Patent Application No. PCT/GB2018/050959, filed on Apr. 11, 2018, which claims priority from and the benefit of United Kingdom patent application No. 1705864.5 filed on Apr. 11, 2017. The entire contents of these applications are incorporated herein by reference.

FIELD OF THE INVENTION

The present invention relates generally to methods of producing ions from a sample, and in particular to methods of analysing the surface of a sample using mass and/or ion mobility spectrometry.

BACKGROUND

A number of ionisation techniques are known for the analysis of surfaces.

One common such technique is matrix-assisted laser desorption ionisation ("MALDI"). This technique generally requires that a matrix is deposited on the sample, and that the sample is placed in a vacuum chamber of an analytical instrument.

The desorption electrospray ionisation ("DESI") technique facilitates analysis of sample surfaces without significant sample preparation and under ambient conditions (e.g. atmospheric conditions). A (primary) spray of charged droplets is directed onto a sample, and subsequent ejected (e.g. splashed) (secondary) droplets carrying desorbed analyte ions are sampled by an inlet capillary of a mass spectrometer.

It is desired to provide an improved method of producing ions from a sample.

SUMMARY

According to an aspect there is provided a method of producing ions from a sample comprising:

directing a spray of droplets onto a sample; and causing droplets comprising analyte from the sample to impact upon a surface so as to generate analyte ions.

Various embodiments are directed to a method of ionising a sample in which analyte ions are generated from the sample by directing a spray of droplets onto the sample, and then causing droplets comprising analyte from the sample to impact upon a surface.

The Applicants have found that the techniques according to various embodiments give rise to droplets carrying analyte from the sample, and that analyte ions can be produced from these droplets by causing them to impact upon a collision surface.

Accordingly, various embodiments facilitate analysis of sample surfaces without significant sample preparation and while the sample is maintained under ambient conditions (e.g. atmospheric conditions).

Moreover, the Applicants have found that the droplets carrying analyte from the sample may be substantially electrically neutral, e.g. where the spray of droplets directed onto the sample is substantially electrically neutral. This means that the droplets carrying analyte can be (and in various embodiments are) transported relatively large distances, e.g. when compared with the charged secondary droplets produced using the DESI technique.

This means that the sample (and the source of the droplets) can be (and in various embodiments is) located at a relatively large distance from the analytical instrument (i.e. from the collision surface and e.g. the analyser), e.g. when compared with the MALDI and DESI techniques. As will be described in more detail below, this can simplify the process of analysing a sample, and can facilitate integration of the technique with a number of different technologies.

Various embodiments also do not require that a high voltage is applied to the droplets. This simplifies the technique, and also means that the technique can be used in a wide range of applications, and to analyse a wide range of samples. For example, the methods according to various embodiments can be used for clinical diagnostics and/or to analyse biological samples in vivo or ex vivo.

It will be appreciated, therefore, that various embodiments provide an improved method of producing ions from a sample.

The spray of droplets may comprise a substantially electrically neutral spray of droplets.

At least some of the droplets comprising analyte from the sample may be substantially electrically neutral.

The spray of droplets may comprise a spray of solvent droplets.

The solvent droplets may include one or more additives.

According to an aspect there is provided a method of producing ions from a sample comprising:

directing a laser beam onto a sample; and causing ablated analyte from the sample to impact upon a surface so as to generate analyte ions.

At least some of the ablated analyte from the sample may be substantially electrically neutral.

The sample may be located at a distance≥0.5 m from the collision surface.

The method may further comprise transporting the analyte from the sample to the collision surface using a flexible tube.

The collision surface may be located within a vacuum chamber of an analytical instrument The method may comprise maintaining the sample at ambient conditions.

The sample may be located within a microtome.

The method may comprise scanning the position of the spray of droplets or the laser beam relative to the sample or scanning the position of the sample relative to the spray of droplets or the laser beam.

The method may comprise:

using a first device to direct the spray of droplets or the laser beam onto the sample; and collecting the analyte from the sample using an inlet;

wherein the first device and the inlet are integrated into a single sampling head or probe.

The inlet may at least partially co-axially surround the first device.

The sampling head or probe may comprise a handheld sampling head or probe.

According to an aspect there is provided a method of analysing a sample comprising:

producing analyte ions from the sample using the method described above; and analysing the analyte ions.

According to an aspect there is provided a method of mass and/or ion mobility spectrometry comprising:

producing analyte ions from a sample using the method described above; and analysing the analyte ions using a mass and/or ion mobility spectrometer.

According to an aspect there is provided apparatus for producing ions from a sample comprising:

a sprayer device configured to direct a spray of droplets onto a sample; and a collision surface;

wherein the apparatus is configured such that droplets comprising analyte from the sample are caused to impact upon the surface so as to generate analyte ions.

The spray of droplets may comprise a substantially electrically neutral spray of droplets.

At least some of the droplets comprising analyte from the sample may be substantially electrically neutral.

The spray of droplets may comprise a spray of solvent droplets.

The solvent droplets may include one or more additives.

According to an aspect there is provided apparatus for producing ions from a sample comprising:

a laser device and/or optical waveguide configured to direct a laser beam onto a sample; and a collision surface;

wherein the apparatus is configured such ablated analyte from the sample is caused to impact upon the surface so as to generate analyte ions.

At least some of the ablated analyte from the sample may be substantially electrically neutral.

The sample may be located at a distance 0.5 m from the collision surface.

The apparatus may further comprise a flexible tube device configured to transport the analyte from the sample to the collision surface.

The collision surface may be located within a vacuum chamber of an analytical instrument The sample may be maintained at ambient conditions.

The sample may be located within a microtome.

The apparatus may be configured to scan the position of the spray of droplets or the laser beam relative to the sample or to scan the position of the sample relative to the spray of droplets or the laser beam.

The apparatus may comprise:

a first device configured to direct the spray of droplets or the laser beam onto the sample; and an inlet configured to collect the analyte from the sample;

wherein the first device and the inlet are integrated into a single sampling head or probe.

The inlet may at least partially co-axially surround the first device.

The sampling head or probe may comprise a handheld sampling head or probe.

According to an aspect there is provided a microtome comprising an integrated ionisation device. According to an aspect there is provided a microtome comprising the apparatus described above.

According to an aspect there is provided an analytical instrument comprising the apparatus described above.

According to an aspect there is provided a mass and/or ion mobility spectrometer comprising the apparatus described above.

The analytical instrument may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation a Quantification mode of operation or an Ion Mobility Spectrometry ("IMS") mode of operation.

BRIEF DESCRIPTION OF THE DRAWINGS

Various embodiments will now be described, by way of example only, and with reference to the accompanying drawings in which.

DETAILED DESCRIPTION

Figure 1:
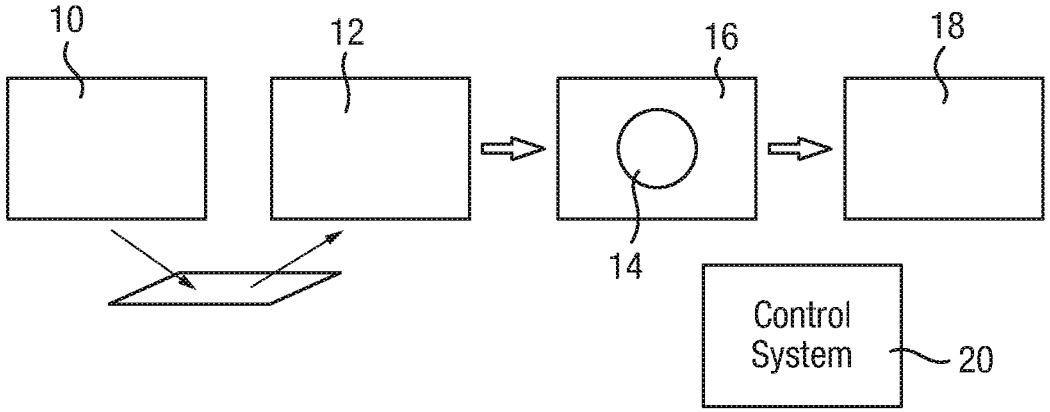
FIG. 1 shows schematically an analytical instrument according to an embodiment.

Various embodiments are directed to a method of ionising a sample in which a spray of droplets is directed onto the sample, and droplets comprising analyte from the sample are caused to impact upon a surface so as to generate analyte ions. Various other embodiments are directed to a method of ionising a sample in which a laser beam is directed onto a sample, and ablated analyte from the sample is caused to impact upon a surface so as to generate analyte ions.

The techniques according to various embodiments may be used for the analysis of any suitable sample. The sample may be analysed directly, e.g. without (significant) sample preparation, and under ambient conditions (e.g. atmospheric conditions).

According to various embodiments, a spray of droplets is directed onto to the sample. The droplets may be directed onto a surface with sample present on the surface and/or directly onto the surface of a sample.

The droplets may comprise droplets of solvent. Any suitable solvent may be used, such as for example, isopropanol, methanol, water, and combinations thereof. One or more additives may be added to the solvent, such as for example, formic acid, ammonia, diethyl amine, etc. Such additive(s) may have the effect of enhancing ionisation, e.g. for certain ion polarities or specific molecular classes. For example, the addition of formic acid can increase the degree of positive ion protonated ions that are produced.

The spray of droplets may be formed in any suitable manner. According to various embodiments, the droplets are produced by a sprayer device such as a nebuliser. The sprayer device may be brought into close proximity with the sample such that the spray of droplets is directed onto the sample.

In these embodiments, the device may be supplied with a liquid (solvent) and a gas (a nebulising gas) such as nitrogen. The liquid may be supplied to a first, e.g. central, capillary of the device, and the gas may be provided to a second capillary that may (at least partially) co-axially surround the first capillary. The arrangement of the capillaries, the flow rate of the solvent and/or the flow rate of the gas may be configured such that solvent droplets are ejected from the device.

According to various embodiments, the spray of droplets is substantially electrically neutral. Thus, the spray of droplets may have a net charge of zero. The droplets may be substantially electrically neutral by virtue of not having a voltage applied to the liquid. As such, the sprayer device according to various embodiments is not provided with (is other than provided with) voltage, and does not comprise (other than comprises) a high voltage ("HV") source. This simplifies the arrangement, and can facilitate use of the technique in a number of different arrangements, e.g. when compared with the DESI technique.

However, it would be possible according to various other embodiments for the spray to be electrically charged. In this case, any suitable voltage may be applied to the liquid, such as (i) 0-1 kV; (ii) 1-2 kV (iii) 2-3 kV (iv) 3-4 kV (v) 4-5 kV (vi) >5 kV. It should be noted, however, that a relatively low voltage may be applied to the liquid (e.g. when compared with the high voltages used for ElectroSpray Ionisation (ESI)). Suitable such voltages would be of the order of a few volts, tens of volts, hundreds of volts, or less. According to various embodiments, a (non-zero) voltage of (i) <500 V; (ii) <250 V; (iii) <100 V; (iv) <50 V; (v) <25 V; (vi) <10 V; (vii) <5 V; (viii) <3 V; or (ix) <1 V, may be applied to the liquid.

According to various embodiments, the spray of droplets is directed onto the surface of the sample such that secondary droplets are reflected or splashed from the surface of the sample. The secondary droplets may be substantially electrically neutral, i.e. may have a net charge of zero.

However, it would be possible according to various other embodiments for at least some of the secondary droplets to have some electrical charge, e.g. where the spray of droplets causes some ionisation of the sample. According to various embodiments, at least some, most or all of the droplets comprising analyte from the sample are substantially electrically neutral.

According to various embodiments, the spray of droplets (or the laser beam) is directed onto the surface of the sample such that analyte is released from the sample. The analyte released from the sample may comprise analyte molecules and/or (larger) analyte particles. The analyte released from the sample may be substantially electrically neutral, i.e. may have a net charge of zero.

However, it would be possible according to various other embodiments for the analyte to be electrically charged (to be ionised). According to various embodiments, at least some, most or all of the analyte released from the sample is substantially electrically neutral.

Some or all of the analyte released from the sample may be carried by (i.e. desorbed into) the secondary droplets, i.e. so as to form the droplets comprising analyte. However, some of the analyte released from the sample may not be (may be other than) carried by (desorbed into) the secondary droplets.

As such, the (e.g. electrically neutral) spray of droplets may be directed at the sample such that subsequent ejected (secondary) droplets carry desorbed analyte (optionally together with non-desorbed analyte, e.g. molecules and/or particles and/or ions). Alternatively, the laser beam may be directed at the sample such that ablated analyte molecules and/or particles and/or ions are released.

According to various embodiments, the droplets comprising (e.g. desorbed) analyte from the sample (optionally together with non-desorbed analyte) (or the ablated analyte) are transported to a collision surface. This may be achieved in any suitable manner.

According to various embodiments, an inlet of a transfer device is provided in close proximity with the sprayer device (or the laser device) and the sample. The inlet may be arranged so as to receive the analyte, e.g. the secondary droplets comprising (e.g. desorbed) analyte from the sample (optionally together with non-desorbed analyte). The transfer device may comprise, for example, a tube or a capillary.

The droplets comprising (e.g. desorbed) analyte from the sample (optionally together with non-desorbed analyte) (or the ablated analyte) may be drawn into the inlet and transported to the collision surface, e.g. due to a low pressure (vacuum) region at the outlet of the transfer device, and/or using a pump such as a Venturi device.

According to various embodiments, the inlet and/or transfer device is not (is other than) heated, i.e. the transfer device is operated at ambient conditions (e.g. atmospheric conditions). This further simplifies the arrangement according to various embodiments. However, it would be possible for the inlet and/or transfer device to be heated, if desired.

The transfer device may be configured to transport the droplets comprising (e.g. desorbed) analyte from the sample (optionally together with non-desorbed analyte) (or the ablated analyte) to the collision surface.

The collision surface may be arranged within a vacuum chamber of an analytical instrument such as a mass and/or ion mobility spectrometer. As such, the transfer device may be connected to the inlet of the analytical instrument.

Alternatively, the collision surface may be arranged external to the analytical instrument, e.g. close to the inlet of the analytical instrument.

Since according to various embodiments the droplets comprising analyte released from the sample (or the ablated analyte) is substantially electrically neutral (or at least comprises relatively little electrical charge), the analyte can be transported relatively large distances. As such, the (inlet of the) analytical instrument can be positioned remotely from the sprayer device (or the laser device), the inlet and the sample. This can simplify the process of analysing a sample, since for example, the sprayer (or laser) device and the inlet can be brought into close proximity with the sample, while the analytical instrument remains relatively remote from the sample (i.e. rather than having to locate the sample within or on close proximity with the analytical instrument). This can also facilitate integration of the technique with a number of different technologies.

According to various embodiments, the sample (and e.g. the sprayer device and the inlet) is located several tens of centimetres or more from the inlet of the analytical instrument and/or from the collision surface. The sample (and e.g. the sprayer device and the inlet) may be located, for example, (i) >0.5 m; (ii) >1 m; (iii) >2 m; and/or (iv) >3 m from the inlet of the analytical instrument and/or from the collision surface.

According to various embodiments, the transfer device comprises a flexible tube, that may have a length of, for example, (i) >0.5 m; (ii) >1 m; (iii) >2 m; and/or (iv) >3 m, e.g. so as to facilitate movement of the sprayer device (or the laser device) and the inlet relative to the sample.

According to various embodiments, the sprayer device (or the laser device) and the inlet are integrated together, i.e. into a single sampling head or probe. The sampling head may be brought into close proximity with the sample in order to direct the spray of droplets (or the laser beam) onto the sample, and to collect the analyte from the sample.

In these embodiments, the sprayer device (or the laser device) and the inlet may be spaced apart from one another in the sampling head or probe, e.g. facing one another, such that the inlet receives the reflected secondary droplets comprising analyte from the sample. In another embodiment, the sprayer device (or the laser device) and the inlet may be integrated together into a co-axial arrangement. For example, the inlet may comprise a capillary that (at least partially) co-axially surrounds the sprayer device (e.g. nebuliser) or the laser device (e.g. optical fibre).

According to various embodiments, the liquid (solvent) supply, gas supply and/or the transfer device (tube) may be integrated together, e.g. into a single connection to the sampling head or probe. According to various embodiments, the laser beam supply, e.g. optical fibre, and the transfer device (tube) may be integrated together, e.g. into a single connection to the sampling head or probe.

According to various embodiments, at least some of the analyte from the sample is caused to ionise upon impacting the collision surface, i.e. resulting in the generation of analyte ions.

A matrix comprising an organic solvent such as isopropanol may be added to the droplets comprising (e.g. desorbed) analyte from the sample or the ablated analyte, e.g. at or prior to the inlet or atmospheric pressure interface of the analytical instrument. The mixture of droplets comprising (e.g. desorbed) analyte from the sample or the ablated analyte and organic solvent may then be arranged to impact upon the (optionally heated) collision surface, e.g. as described above. At least some of the droplets comprising (e.g. desorbed) analyte from the sample or the ablated analyte may be caused to ionise upon impacting the collision surface resulting in the generation of analyte ions. The ionisation efficiency of generating the analyte ions may be improved by the addition of the organic solvent. However, the addition of an organic solvent is not essential.

The collision surface may comprise any suitable such collision surface. The collision surface may be formed from any suitable material, such as a metal or a ceramic. The collision surface may be heated. This can improve the ionisation efficiency.

The analyte ions may then be passed through subsequent stages of the analytical instrument, and e.g. subjected to one or more of: separation and/or filtering using a separation and/or filtering device, fragmentation or reaction using a collision, reaction or fragmentation device, and analysis using an analyser.

As such, according to various embodiments, the analyte ions are analysed. The analyte ions may be (directly) analysed, and/or ions derived from the analyte ions may be analysed. For example, some or all of the analyte ions may be fragmented or reacted so as to produce product ions, e.g. using a collision, reaction or fragmentation device, and these product ions (or ions derived from these product ions) may then be analysed.

Suitable collision, fragmentation or reaction cells include, for example: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and/or (xxix) an Electron Ionisation Dissociation ("EID") fragmentation device.

Some or all of the analyte ions or ions derived from the analyte ions may be filtered, e.g. using a mass filter. Suitable mass filters include, for example: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and/or (viii) a Wen filter.

According to various embodiments, the analyte ions or ions derived from the analyte ions are mass analysed, e.g. using a mass analyser, i.e. so as to determine their mass to charge ratio.

Suitable mass analysers include, for example: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and/or (xiv) a linear acceleration Time of Flight mass analyser.

Additionally or alternatively, the analyte ions or ions derived from the analyte ions may be analysed using an ion mobility separation device and/or a Field Asymmetric Ion Mobility Spectrometer device.

As discussed above, locating the sample at a relatively large distance from the collision surface and/or analyser according to various embodiments facilitates convenient use in a number of different arrangements.

According to various embodiments, the device may be integrated into, for example: (i) a slide scanning instrument; (ii) a handheld scanning instrument; (iii) a microtome such as a cryomicrotome; and/or (iv) an in vivo or ex vivo scanning instrument. Other arrangements would be possible.

According to various embodiments, the methods and apparatus according to various embodiments are employed in apparatus for and methods of mass spectrometry imaging. This is possible, for example, since the sampling head can be moved relative to the sample in a relatively straightforward manner.

Thus, according to various embodiments, the spray (or the laser beam) is moved, e.g. (automatically) scanned, across the surface of the sample (or the sample is moved relative to the spray), e.g. so as to obtain analyte from multiple different positions on the sample. This analyte (e.g. droplets comprising the analyte) is impacted upon the collision surface to produce analyte ions, and the analyte ions may be analysed, e.g. so as to generate an ion image or map of the sample.

According to various embodiments, the methods and apparatus according to various embodiments are employed in a handheld sampling device. The handheld sampling device may incorporate at least the sprayer device (or laser device) and the inlet, and may be connected to an analytical instrument via one or more flexible tubes (e.g. which may comprises a liquid (solvent) supply, gas supply, and transfer tube). The handheld device may be used to analyse any suitable sample, such as for example, a person's hands, a product, etc.

According to various embodiments, the methods and apparatus according to various embodiments are employed in a microtome such as a cryomicrotome. In these embodiments, the spray (or laser beam) may be directed onto a tissue section or tissue sample within the microtome device. A tissue sample may be cut into tissue sections, and the tissue sections or the remaining exposed face of the sample may be analysed using the techniques described herein. According to various embodiments, a three dimensional ion image or map may be obtained in this manner.

The methods and apparatus according to various embodiments may be employed to image biological samples such as tissue sections. The methods and apparatus according to various embodiments may be employed for in vivo or ex vivo analysis of samples.

Although various embodiments have been described in terms of directing a spray of droplets onto a sample, it would alternatively be possible to direct a laser beam onto a sample, i.e. in order to ablate analyte from the sample. The ablated analyte may then be caused to impact upon the collision surface so as to generate analyte ions, e.g. in a corresponding manner to that discussed above.

It will be appreciated that various embodiments are directed to the de-clustering of atmospheric pressure desorption droplets on an optionally heated impactor surface for the analysis of surfaces at remote distances.

FIG. 1 shows an analytical instrument, e.g. mass and/or ion mobility spectrometer, in accordance with various embodiments. The analytical instrument comprises a sprayer device 10, a transfer device 12, a collision surface 14 located within a first vacuum chamber 16 of the instrument e.g. within a source region of the instrument, and an analyser 18 located downstream of the collision surface 14. The analyser 18 may be located within one or more further vacuum chambers of the instrument, e.g. that may be maintained at a lower pressure to the first vacuum chamber 16.

According to various alternative embodiments, the sprayer device 10 may be replaced with a laser device.

As shown in FIG. 1, according to various embodiments, a control system 20 may be provided. The control system 20 may be configured to control the operation of the analytical instrument, e.g. in the manner of the various embodiments described herein. The control system may comprise suitable control circuitry that is configured to cause the instrument to operate in the manner of the various embodiments described herein. The control system may also comprise suitable processing circuitry configured to perform any one or more or all of the necessary processing and/or post-processing operations in respect of the various embodiments described herein.

Various embodiments are particularly useful in imaging or surface profiling mass spectrometry, and have the potential to be a powerful technique for integration into clinical diagnostic workflows. Various embodiments address the limitations of prior ionisation techniques wherein it is necessary to position the sample in a vacuum chamber of the instrument (e.g. in Matrix Assisted Laser Desorption/Ionisation ("MALDI") techniques) or on a stage or sample holder in very near proximity to the instrument (e.g. in ambient techniques such as Desorption Electrospray Ionisation ("DESI")).

According to various embodiments, large solvent droplets containing molecules collected from a sample surface, or particulate matter of a sample, can be transported sufficient distances (e.g. >around 0.5 m, or >around 1 m) such that the point of sampling can be relatively distant from the analytical instrument (e.g. mass spectrometer) inlet.

In particular, by directing a nebulised solvent (or alternatively a laser beam) onto a surface, and placing a collection capillary or tube substantially opposite the spray, the desorbed or ablated material may be carried through the tube 12 to a heated collision surface 14 upon which molecular ions may be released to be analysed.

Molecular profiles can be generated from these surfaces without providing a high voltage to the sprayer 10 and without heating the collection capillary 12. The removal of the requirement for a high voltage simplifies the process (e.g. since there is no need to supply a high voltage to the solvent) and makes it more compatible for integration with various systems. For example, such an arrangement lends itself to integration into third party instruments, such as slide scanning instruments, field sampling systems, cryomicrotomes for block face imaging, and in-vivo analysis.

In addition, the removal of the requirement for a high voltage means that significant safety and engineering considerations are removed or reduced.

Figure 2:
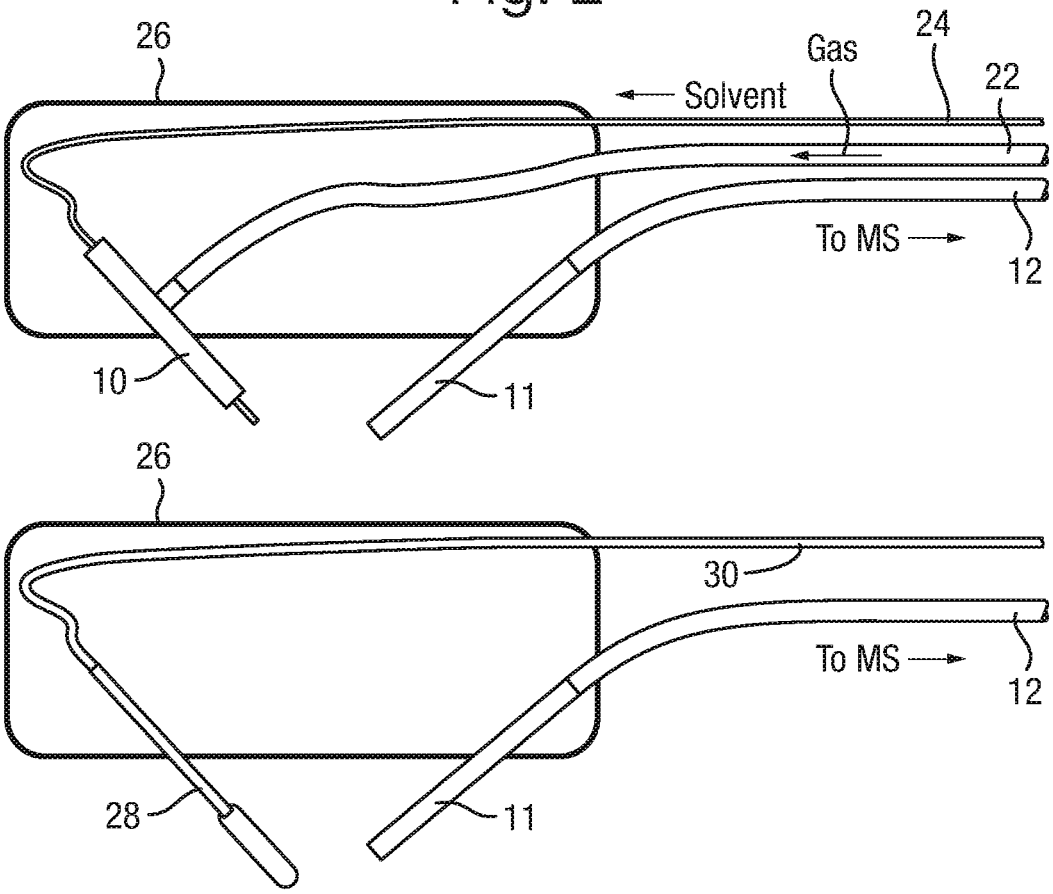
FIG. 2A shows schematically a sampling head according to an embodiment.
FIG. 2B shows schematically a sampling head according to an embodiment.

FIG. 2A shows the sprayer device 10 and the transfer device 12 in accordance with various embodiments. As shown in FIG. 2A, the sprayer device 10 may be provided with a nebulising gas supply or capillary 22 and a solvent supply or capillary 24. As shown in FIG. 2A, the solvent supply 24, nebulising gas supply 22 and the inlet 11 of the transfer tube or capillary 12 may all be fitted into a single sampling head or probe 26. The sampling head may be brought towards the surface of the sample when required.

FIG. 2B shows a sampling head or probe 26 according to an alternative embodiment, whereby the sprayer device 10 is replaced with a laser device 28 such as a laser ablation or water matrix MALDI device. As shown in FIG. 2B, the laser device 28 may be provided with laser light via a fibre optic cable 30. The fibre optic cable 30 and the transfer tube 12 may have a single co-axial design.

Although FIGS. 2A and 2B illustrate arrangements in which the sprayer device 10 or the laser device 28 are spaced apart from and facing the inlet 11, it would also be possible for the sprayer device 10 or the laser device 28 to be integrated together with the inlet 11 in a co-axial arrangement, e.g. where the inlet capillary 11 at least partially co-axially surrounds the sprayer device 10 or the laser device 28.

Droplets of solvent with dissolved material from the surface of the sample, or desorbed particulate matter, may be drawn into the inlet 11 and down the transfer device (tube) 12 by the vacuum of the analytical instrument or a pump such as a Venturi device. As no charge is imparted onto the analyte at this point, the net neutral droplets or ablated material can travel a significant distance.

In order to de-cluster and ionised these droplets, an impactor surface 14 is provided, e.g. that may be placed in the path of the material as it enters the source region of the analytical instrument.

Figure 3A:
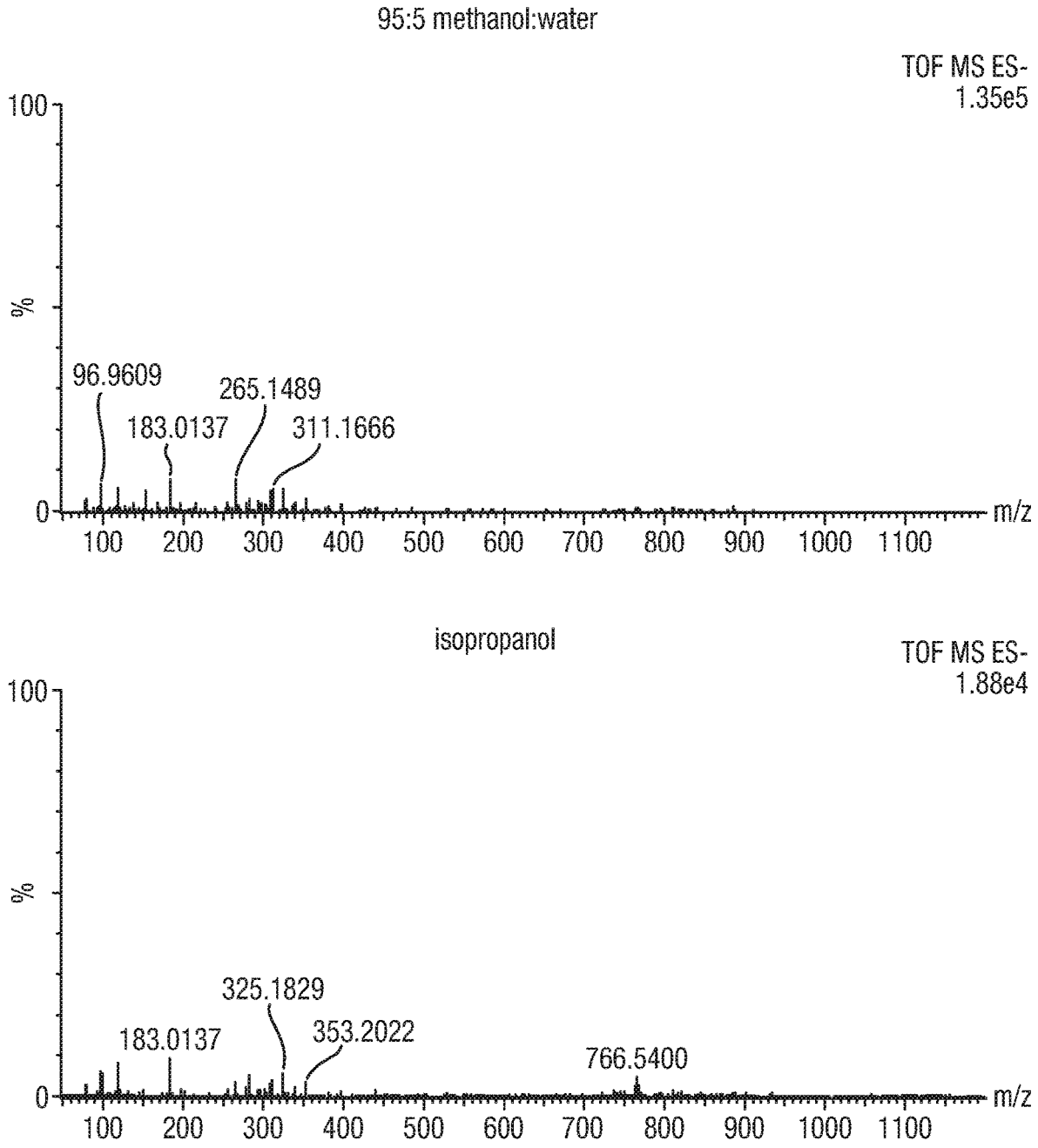
FIG. 3A shows mass spectra obtained without using a collision surface.
Figure 3B:
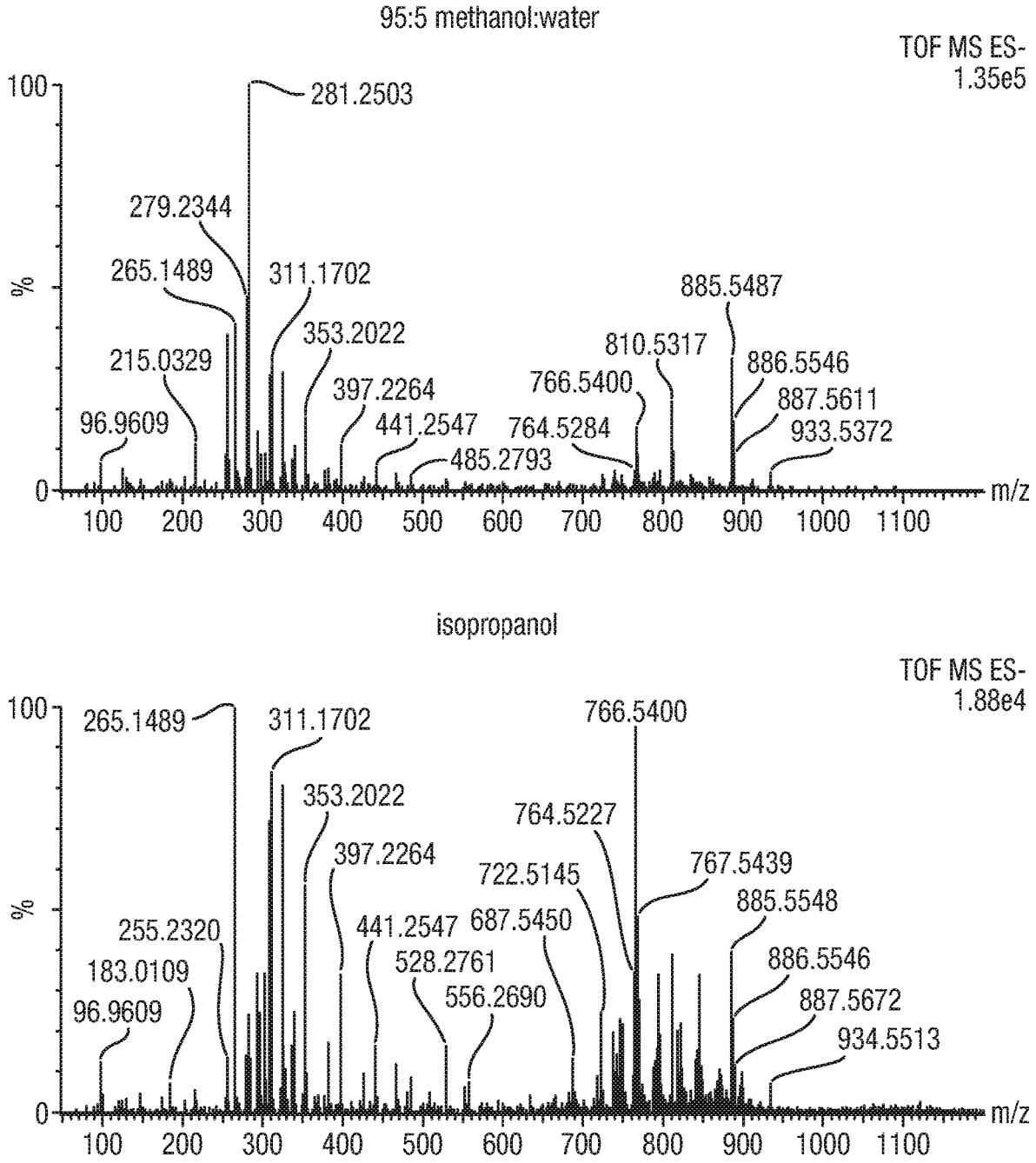
FIG. 3B shows mass spectra obtained using a collision surface according to an embodiment.

FIG. 3 shows spectra collected from a liver section sample on a glass slide without using a voltage, nor a heated capillary. FIG. 3A shows data from two different solvent systems (namely 95:5 methanol:water, and isopropanol), without use of a heated collision surface, and FIG. 3B shows data from the two different solvent systems, with use of a heated collision surface.

As shown in FIG. 3, the removal of the collision surface causes a significant decrease in ion signal obtained. This demonstrates that the primary ionisation mechanism according to various embodiments is associated with the droplets colliding with the collision surface.

Figure 4:
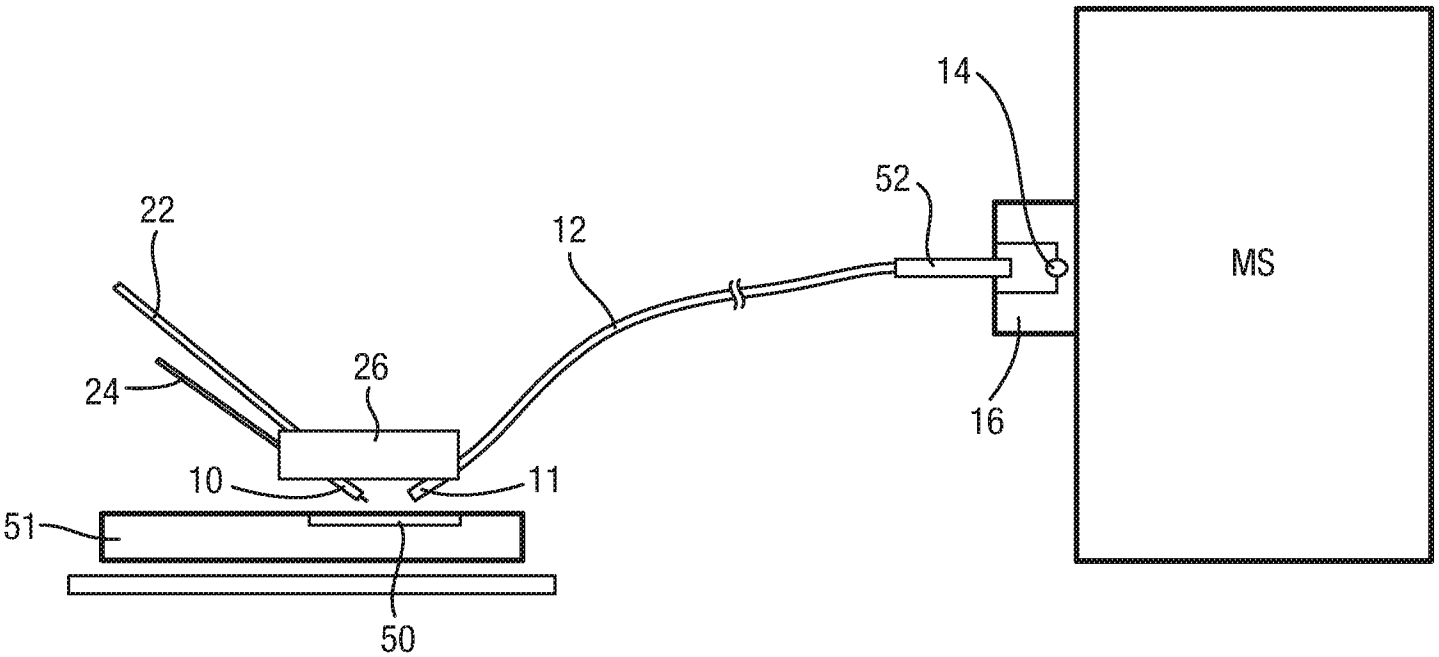
FIG. 4 shows an analytical instrument according to an embodiment.

FIG. 4 illustrates an arrangement for mass spectrometry imaging according to various embodiments. A sample 50 is mounted on a position controllable stage 51. The position controllable stage 51 is movable relative to the sampling head 26.

The arrangement illustrated in FIG. 4 uses distant sampling (i.e. a 50 cm flexible transfer tube 12 is connected to the inlet capillary 52 of a mass spectrometer) and no voltage is provided on the solvent or gas spray. However, it would be possible to provide a voltage to the solvent, if desired.

In the arrangement of FIG. 4, the collection tube 11 and the transfer tube 12 is not heated. However, it would be possible to heat the collection tube 11 and/or the transfer tube 12, if desired.

Figure 5A:
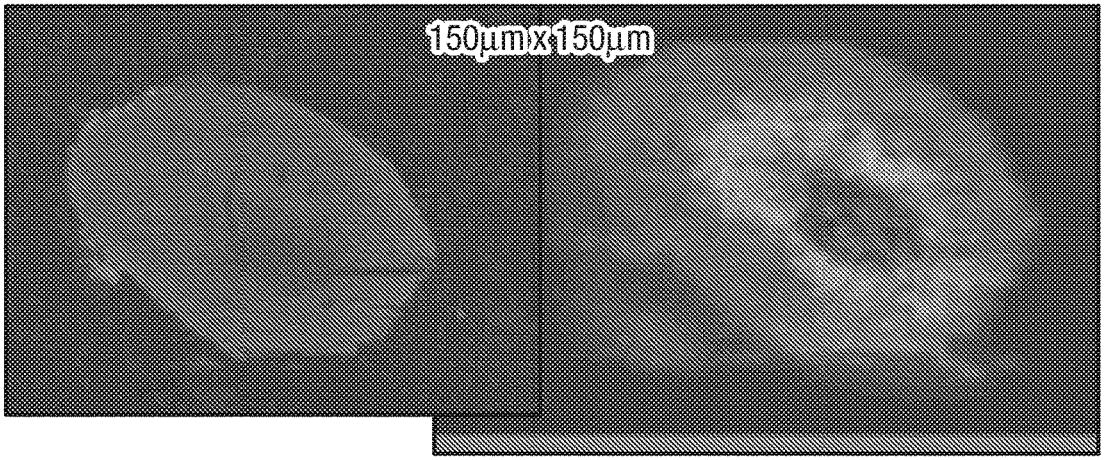
FIG. 5A shows a mass spectrometry image obtained according to an embodiment.
Figure 5B:
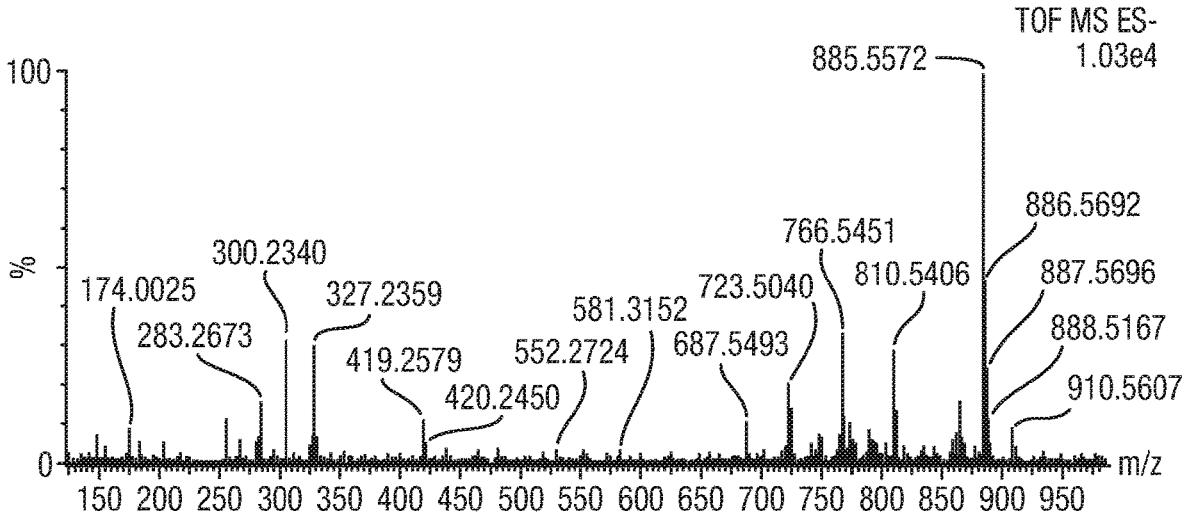
FIG. 5B shows a mass spectrum obtained according to an embodiment.

FIGS. 5A and 5B show data for three lipid species for a mouse kidney. This demonstrates the capability of the system according to various embodiments to image tissue sections without a voltage at a significant distance from the inlet of the analytical instrument.

According to various embodiments, the impactor surface 14 may be within the intermediate vacuum 16 of the source region of the analytical instrument. The collision surface 14 may have the form of a metal or ceramic surface.

According to various embodiments, the impactor surface 14 may be directly outside the vacuum of the analytical instrument. The collision surface 14 may have the form of a heated plate or section of capillary prior to the inlet of the analytical instrument.

According to various embodiments, the impactor surface 14 may be heated.

The sampling device according to various embodiments only requires solvent, gas and collection lines (and does not require a high voltage source or heating), and may therefore be easily implemented in a range of applications.

For example, as described above, a remote sampling probe 26 may be provided as a single piece comprising a sprayer 10 opposite a collection tube 11. This sampling probe 26 may then be positioned within a range of third party instrumentation, e.g. to enhance the ease and applicability of obtaining mass spectrometric data, e.g. from clinical and preclinical samples.

FIG. 6 illustrates various possible applications of the approach according to various embodiments.

Figure 6A:
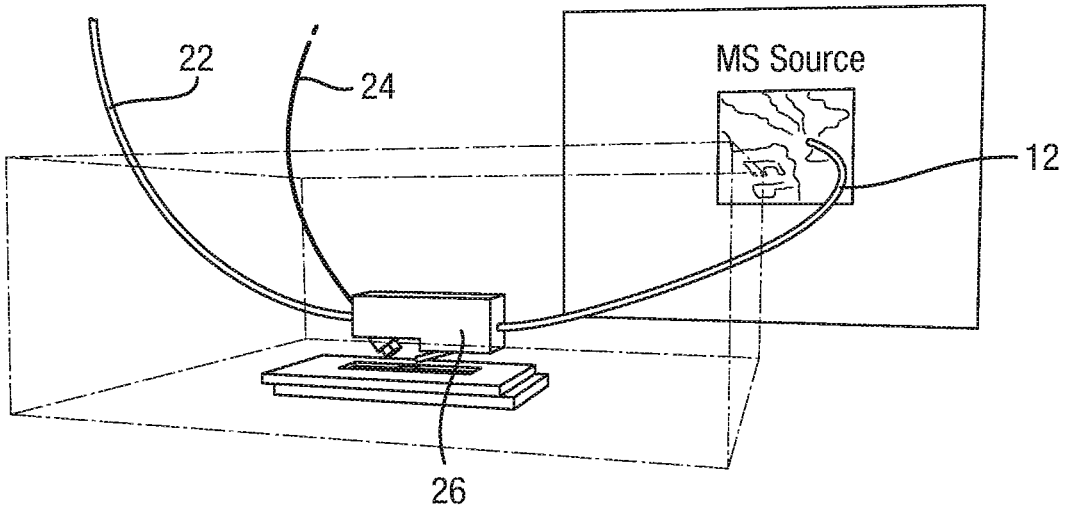
FIG. 6A shows a slide imaging device according to an embodiment.

FIG. 6A illustrates integration of the technique into a digital slide scanner device. As shown in FIG. 6A, the sampling probe 26 may be incorporated into a digital slide scanner, e.g. as a selective option alongside the normal cameras and lenses.

Figure 6B:
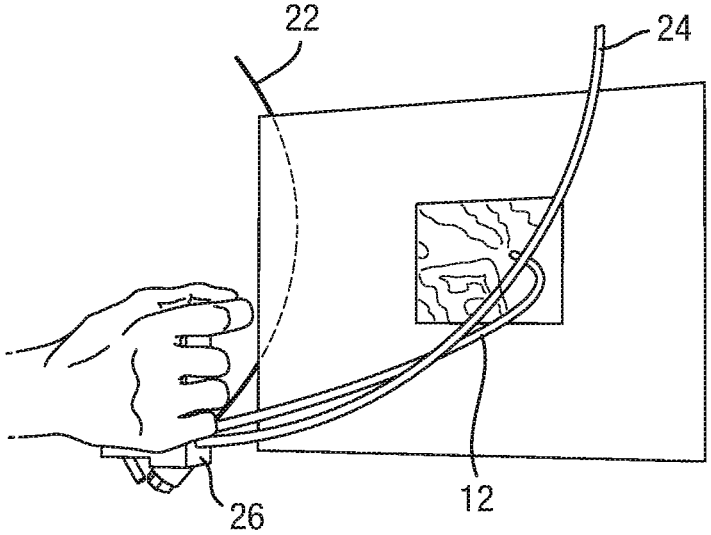
FIG. 6B shows a handheld sampling device according to an embodiment.

FIG. 6B illustrates a sampling "wand" according to various embodiments. As shown in FIG. 6B, the sampling probe 26 may form part of a handheld device. Such a device may be used, for example, for the rapid analysis of surfaces such as a person's hands at an airport or a product after a cleaning procedure. Although FIG. 6B shows three separate gas 22, solvent 24 and collection 12 lines, these could alternatively be integrated into a single line.

According to various embodiments, a handheld sampling device may be used in vivo or ex vivo to analyse and/or classify tissues, e.g. based on metabolite and/or lipidomic signatures. Such a handheld sampling device may allow in vivo or ex vivo identification of tissue in seconds, e.g. for intra-operative use.

In this regard, e.g. for handheld probes, the techniques according to various embodiments have the benefit of providing a source of ions from the surface of a sample without the requirement of high voltage, plasma or heat at the point of sampling.

According to various embodiments, a handheld sampling device 26 may incorporate a means of recording the spatial position of the point of analysis, e.g. in the x, y, and z dimensions and/or a time stamp.

Figure 6C:
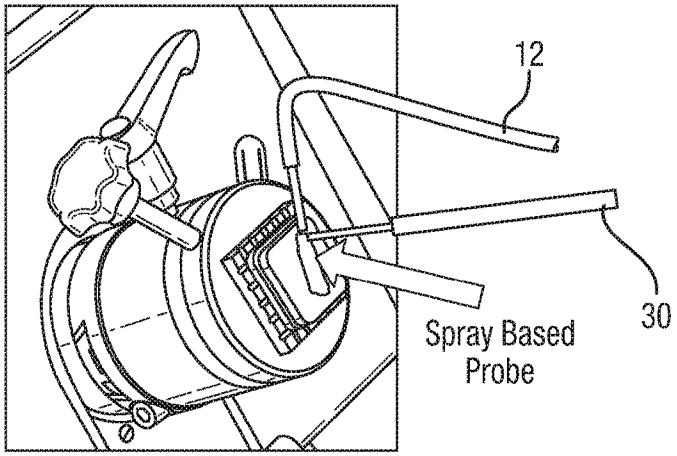
FIG. 6C shows a cryomicrotome device according to an embodiment.

FIG. 6C illustrates the provision of a spray head 26 suitable to be incorporated into a microtome such as a cryomicrotome. According to various embodiments, the sampling probe may be fitted above the blade in the cryomicrotome, thereby allowing the newly exposed tissue face to be sampled.

Such an arrangement can allow accurate mapping of in situ tissue on the microtome sample mount. This may be followed by the cutting of a new section to present a new face, and analysis of the new face, and so on.

The arrangement greatly simplifies the analysis of a sample, since for example, the tissue sections do not need to be placed onto glass slides. A map of the surface can be made followed by a large (e.g. ~100 micron) section cut, before the next ion image is produced. This process may be automated to allow a whole tissue sample to be analysed in minutes.

Maintaining the tissue sample within a cryomicrotome during its analysis also has the effect of preserving the sample.

In these embodiments, a solvent other than water may be used, e.g. a suitable solvent to avoid freezing of the spray such as isopropyl alcohol, e.g. where the cryomicrotome is operated at low temperature (e.g. around −20° C.).

Figure 6D:
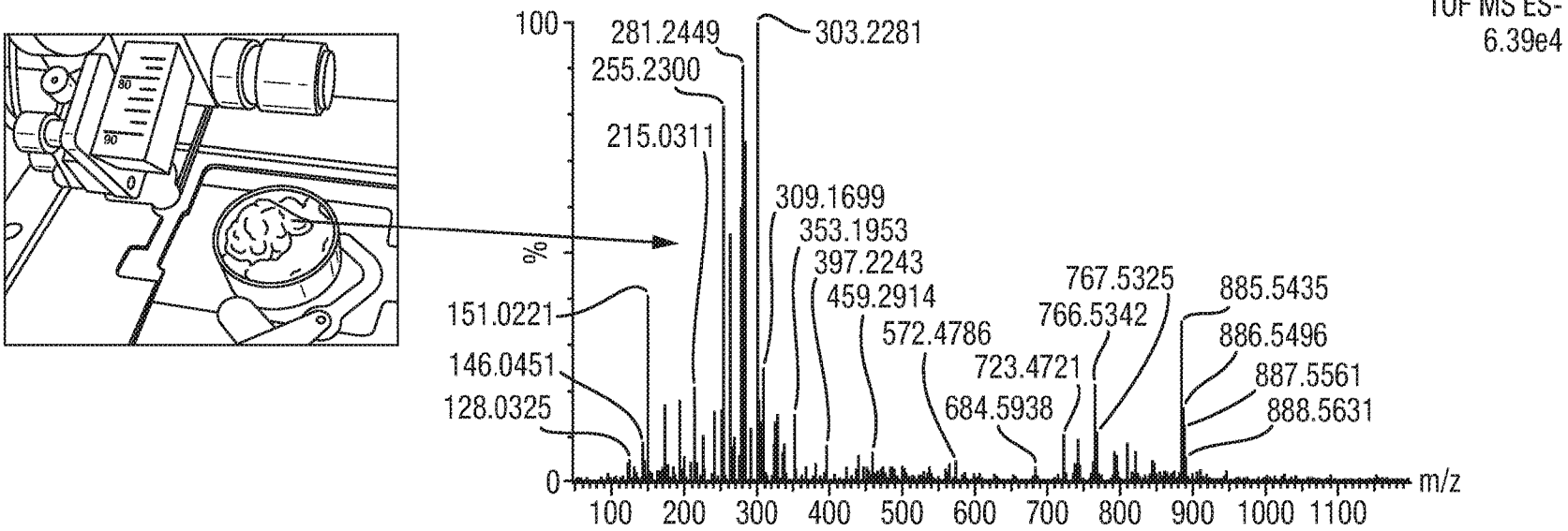
FIG. 6D shows a mass spectrum obtained according to an embodiment.

FIG. 6D shows mass spectrometric data obtained from a cold block of tissue. This demonstrates the feasibility of the approach according to various embodiments.

Figure 7:
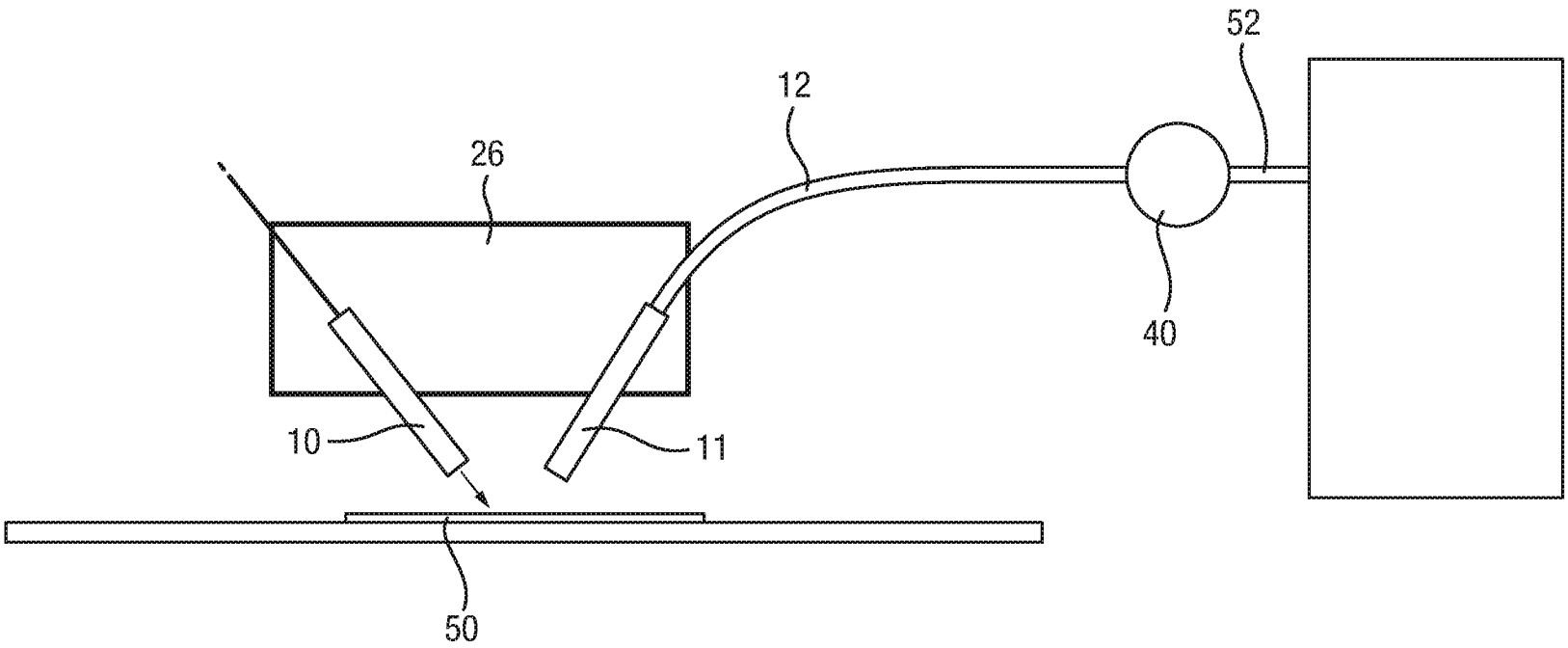
FIG. 7 shows schematically an analytical instrument according to an embodiment.

FIG. 7 shows an arrangement according to various embodiments, whereby an organic solvent such as isopropanol is added to the droplets comprising desorbed analyte from the sample or the ablated analyte, prior to the atmospheric pressure interface of the analytical instrument. This may be done by a solvent dosing device 40. The mixture of droplets comprising desorbed analyte from the sample or the ablated analyte and organic solvent is arranged to impact upon the collision surface 14, e.g. as described above, to generate analyte ions. The ionisation efficiency of generating the analyte ions can be improved by the addition of the organic solvent. However, the addition of an organic solvent is not essential.

The ambient sampling device according to various embodiments may incorporate a focused microwave or ultrasound source.

Various alternative embodiments are directed to atmospheric pressure laser ablation, e.g. from frozen samples in a cryomicrotome.

Various embodiments remove the need of any sample preparation, and can bring imaging (or profiling) mass spectrometry directly into the standard workflow of histopathology.

Although the present invention has been described with reference to preferred embodiments, it will be understood by those skilled in the art that various changes in form and detail may be made without departing from the scope of the invention as set forth in the accompanying claims.

The invention claimed is:

1. A method of producing ions from a sample comprising:

directing a substantially electrically neutral spray of droplets onto a sample using a nebulizer so as to form substantially electrically neutral secondary droplets comprising analyte from the sample; and causing the secondary droplets comprising analyte from the sample to impact upon a surface so as to generate analyte ions.

2. The method of claim 1, wherein the spray of droplets comprises a spray of solvent droplets.

3. The method of claim 2, wherein the solvent droplets include one or more additives.

4. A method of analysing a sample comprising:

producing analyte ions from the sample using the method according to claim 1; and analysing the analyte ions.

* * * * *